US007198468B2

(12) United States Patent
Papple

(10) Patent No.: US 7,198,468 B2
(45) Date of Patent: Apr. 3, 2007

(54) INTERNALLY COOLED TURBINE BLADE

(75) Inventor: Michael Leslie Clyde Papple, Ile des Soeurs (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 121 days.

(21) Appl. No.: 10/890,984

(22) Filed: Jul. 15, 2004

(65) Prior Publication Data

US 2006/0013688 A1 Jan. 19, 2006

(51) Int. Cl.
*F01D 5/18* (2006.01)

(52) U.S. Cl. ..... 416/97 R

(58) Field of Classification Search ..... 416/95, 416/96 R, 97 R, 232, 233
See application file for complete search history.

(56) References Cited

U.S. PATENT DOCUMENTS 3,045,965 A * 7/1962 Bowmer ..... 416/97 R
4,416,585 A * 11/1983 Abdel-Messeh ..... 416/97 R
5,246,341 A 9/1993 Hall et al.
5,403,157 A * 4/1995 Moore ..... 416/97 R
5,403,159 A 4/1995 Green et al.
5,464,322 A 11/1995 Cunha et al.
5,591,007 A 1/1997 Lee et al.
5,700,131 A 12/1997 Hall et al.
5,975,851 A 11/1999 Liang
6,033,181 A 3/2000 Endres et al.
6,089,822 A 7/2000 Fukuno
6,126,396 A 10/2000 Doughty et al.
6,139,269 A 10/2000 Liang
6,179,565 B1 1/2001 Palumbo et al.
6,234,754 B1 5/2001 Zelesky et al.
6,435,813 B1 8/2002 Rieck, Jr. et al.
6,607,356 B2 8/2003 Manning et al.

FOREIGN PATENT DOCUMENTS

JP 58202303 A * 11/1983

* cited by examiner

*Primary Examiner*—Richard A. Edgar
(74) *Attorney, Agent, or Firm*—Ogilvy Renault LLP

(57) ABSTRACT

A partial rib for use in a turbine blade is disclosed which provides one or more of improved strength, air flow distribution and cooling. In one embodiment, the rib has a height of between 0.3 and 0.9 of the airfoil height.

8 Claims, 3 Drawing Sheets

INTERNALLY COOLED TURBINE BLADE

TECHNICAL FIELD

The invention relates to internally cooled turbine blades of a gas turbine engine.

BACKGROUND

The design of gas turbine blades is the subject of continuous improvement, since design directly impacts cooling efficiency. In hot environments, blade material creep is a perennial problem. Therefore, there continues to be a need for improved strength and improved cooling for internally cooled turbine blades.

SUMMARY

In one aspect the present invention provides an internally cooled turbine blade for a gas turbine engine, the turbine blade having an airfoil section having a height H measured radially relative to the blade's orientation when installed in a turbine disc, the blade comprising at least one internal cooling passage defined in the blade, the passage having a partial rib disposed therein immediately adjacent a plurality of air passage outlets in a trailing edge of the blade, the rib having a height h and a plurality of impingement holes defined therethrough which communicate with the passage, wherein the rib height h is between 0.3 and 0.9 of the height H of the airfoil section.

In another aspect, the invention provides a turbine blade for use in a gas turbine engine, the turbine blade comprising a root section and an airfoil section with at least one internal cooling air passage, the turbine blade having a trailing edge and a partial rib disposed in the passage adjacent the trailing edge and extending radially from the root section, the partial rib having a plurality of impingement holes and a radial height h between 0.3 to 0.9 of a radial height H of the airfoil section, the rib thereby being adapted to balance a flow of cooling air through the passage to a plurality of exit holes adjacent the rib.

In another aspect the invention provides a gas turbine engine turbine blade, the turbine blade comprising a base section, an airfoil section and at least one internal cooling air passage, the airfoil having a having a trailing edge including a plurality of exit holes disposed therealong, the exit holes communicating with the internal cooling air passage, the exit holes being arranged relative to the passage such that the exit holes include at least one lower exit hole and at least one upper exit hole relative to the base section, the internal cooling air passage having a partial rib disposed therein which extends radially from the base section adjacent the trailing edge, the rib adapted to at least partially divert a flow in the passage therearound to redistribute pressure of the flow relative to the upper and lower exit holes.

Still other aspects and inventions will be apparent in the appended description and figures.

DETAILED DESCRIPTION

Figure 1:
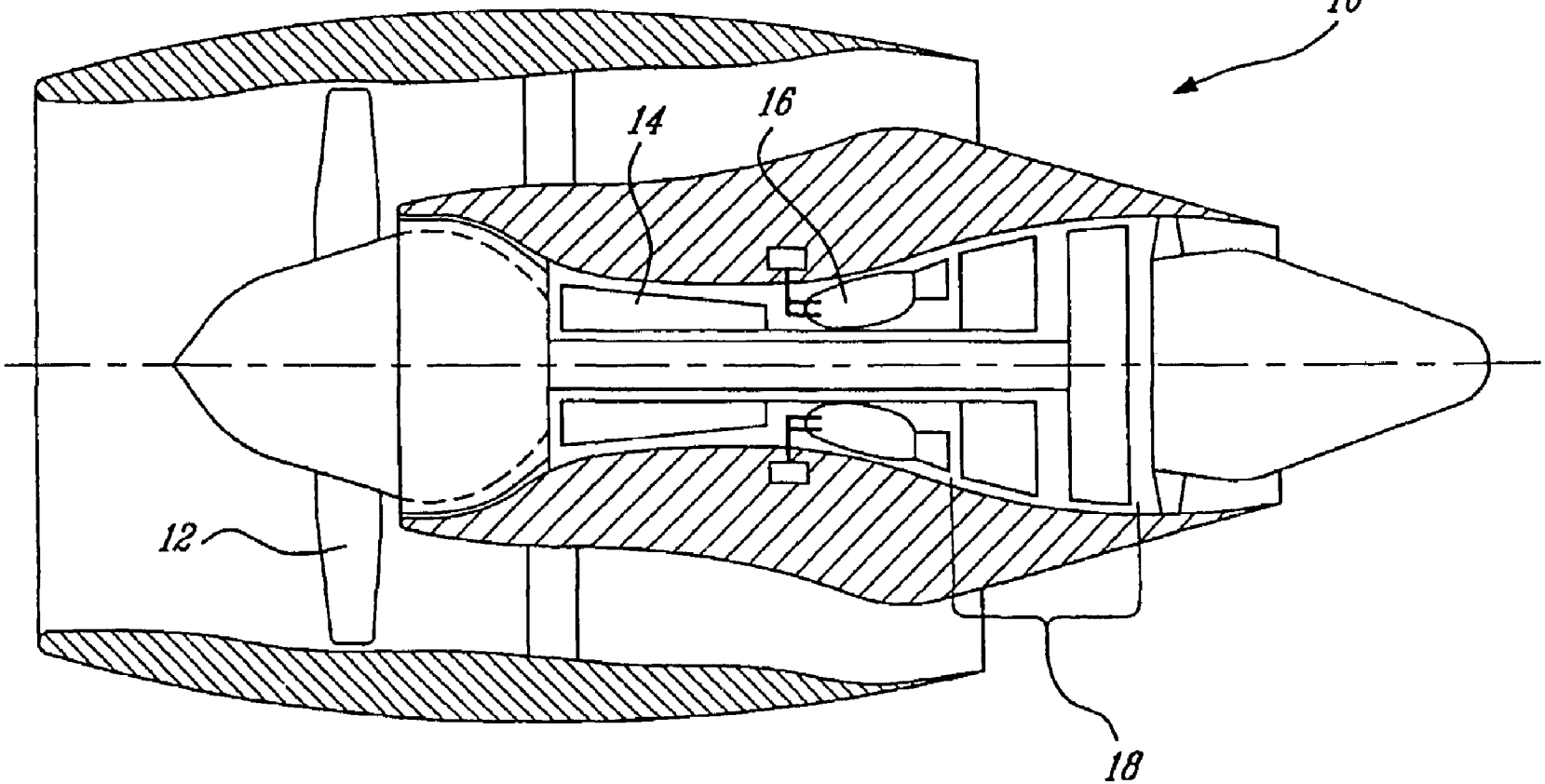
FIG. 1 shows a generic gas turbine engine to illustrate an example of a general environment in which the invention can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
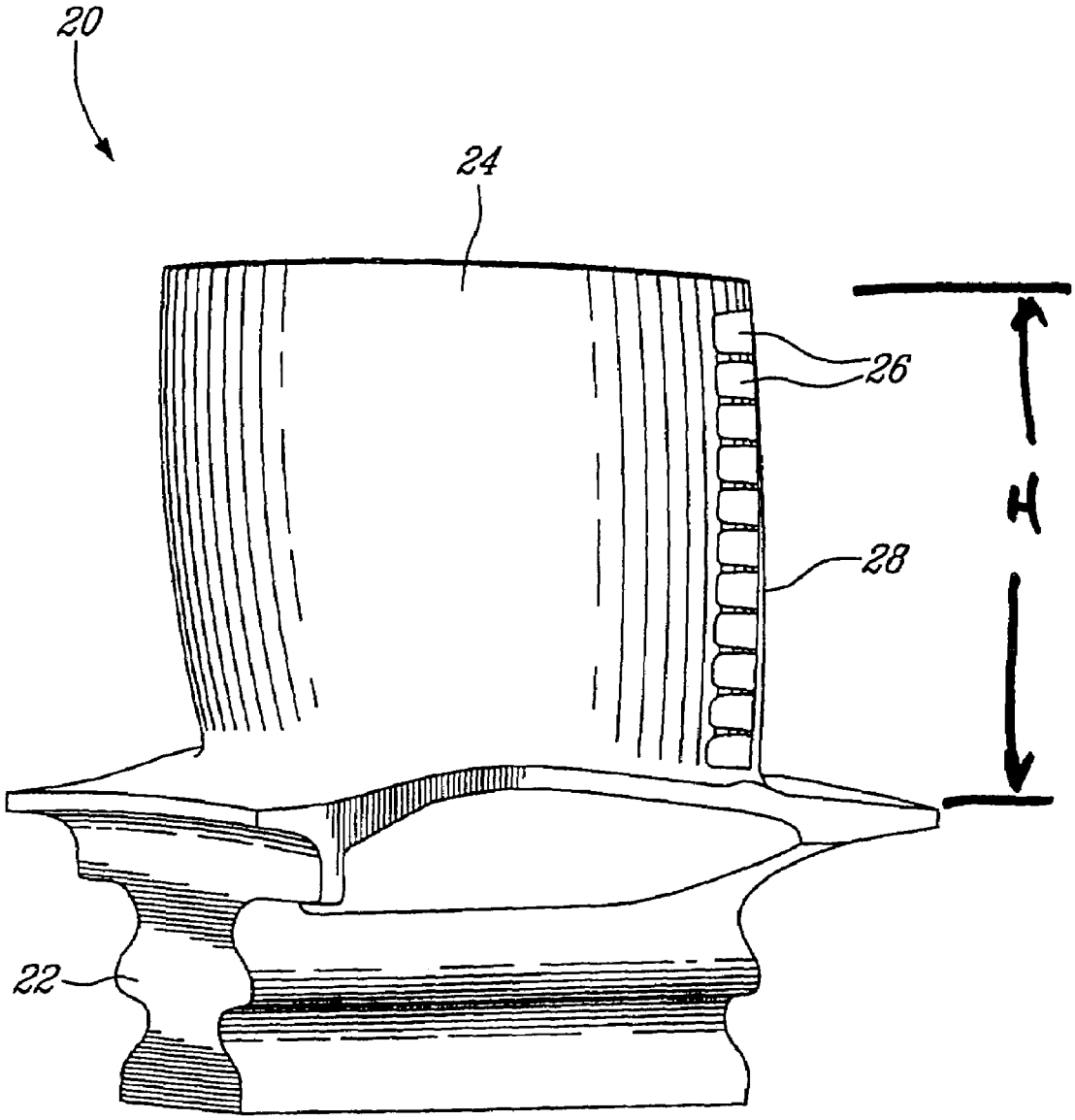
FIG. 2 is a perspective view of an example of a turbine blade used in gas turbine engine.

FIG. 2 shows an example of a turbine blade 20 that can be used in the turbine section 18 of the gas-turbine engine 10. The exact shape of the turbine blade 20 depends on its location within the turbine section 18, the operating parameters of the gas turbine engine 10, etc. The turbine blade 20 comprises a root section 22 and a airfoil section 24 generally radially extending from the root section 22. The root section 22 is mounted into a corresponding recess of a rotary support structure of the turbine wheel (not shown).

The root section 22 of the turbine blade 20 includes a cooling air inlet or inlets (not shown) receiving cooling air from a plenum typically located adjacent the blade. The cooling air inlet or inlets lead to the interior of the airfoil section 24.

The airfoil section 24 has at least one internal passage for air distribution therethrough to one or more exits, typically in the trailing edge 28, such as exhaust ports 26. Air may also exit through a network of holes (not shown) provided for surface film cooling on parts of the external skin of the turbine blade 20.

Figure 3:
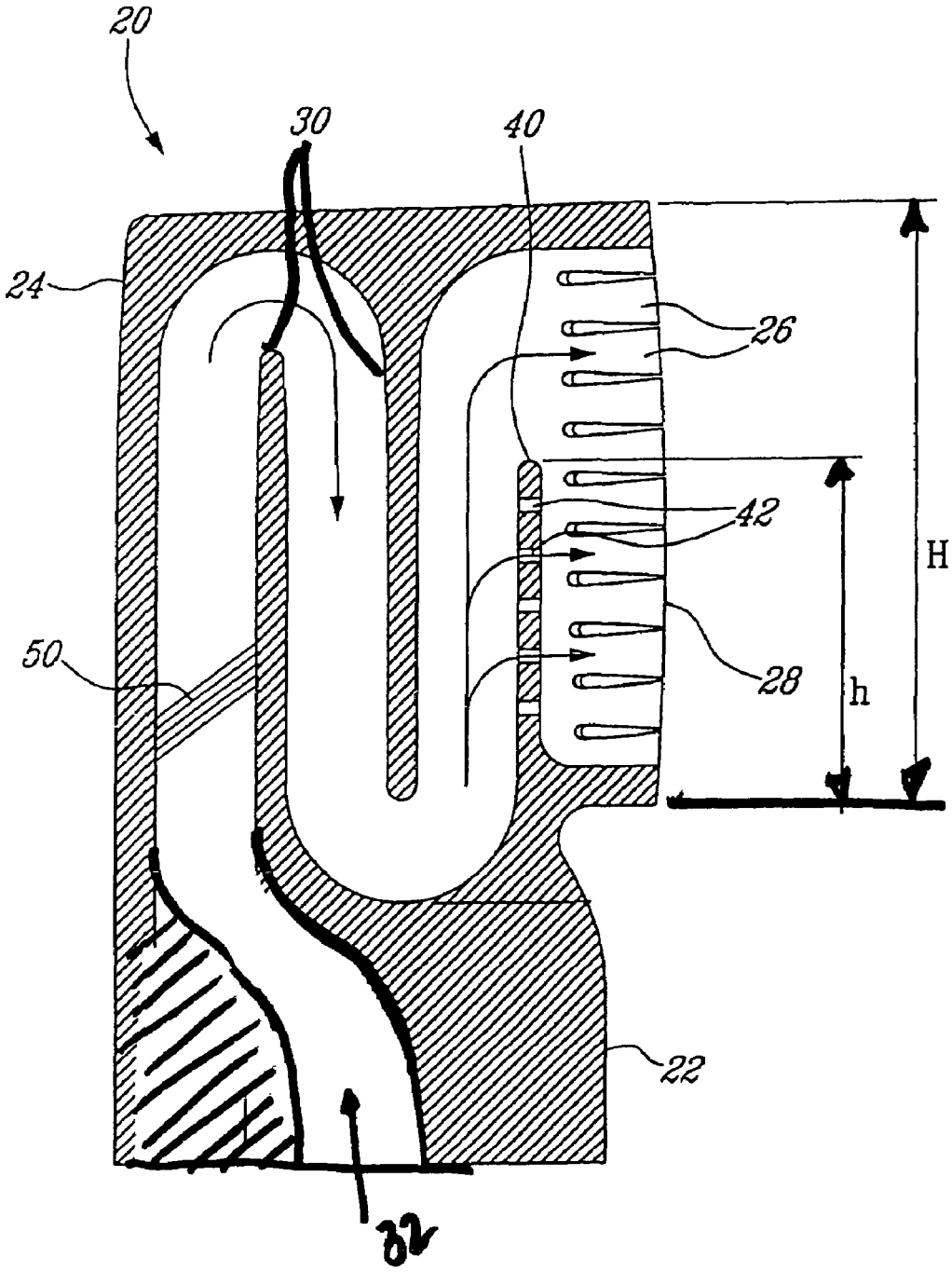
FIG. 3 is a schematic cross sectional view illustrating the interior of a turbine blade with the invention.

FIG. 3 schematically illustrates the interior of the turbine blade 20 in which the airfoil section 24 is provided with a partial rib 40. Partition walls 30 redirect the flow of cooling air in one or more passages 32. Only one passage 32 is illustrated in FIG. 3. Cooling air coming from the inlet or inlets in the root section 22 is directed into the airfoil section 24, from which in this embodiment it is discharged through the trailing edge 28 at the rear of the turbine blade 20. Means 50 for promoting internal heat transfer may be provided, such as trip strips, pedestals, baffles, etc. The air inlets and exits, and general nature and number of the cooling passage(s) forms no part of the present invention, however.

The partial rib 40 is provided immediately adjacent exit holes 26 in trailing edge 28, and partially "block" at least some holes 26 from direct access by passage 32. Rib 40 has a height h preferably ranging between about 0.3 and 0.9 the height (H) of the airfoil section 24. More preferably, the ratio H/h is between 0.4 and 0.8. The rib 40 has a plurality of openings 42 for permitting air in passage 32 to pass therethrough for exit from holes 26. It will be noted that in this embodiment that trailing edge exits 26 span the entire distance H, and thus the rib height h is sized to "blocks" those exit holes 26 which a cooling flow through passage 32 may tend to prefer, by reason of their placement "upstream" of the other exit holes 26 (i.e. in the absence of rib 40). In this manner, rib 40 provides some pressure redistribution, and openings 42 may be used to affect redistribution, as well. Rib 40 thus serves as a flow redistribution baffle. The skilled reader will recognize that, in an embodiment where exit holes 26 do not span the entire height H of the blade, that the design and height h of rib 40 may be modified to achieve the above described benefits in design.

Providing a partial rib 40 has been found to be effective compensation for a low or reduced pressure differential between the interior and the exterior of the turbine blade 20.

The rib 40 also provides strengthening in the nearby region (i.e. rear) of the turbine blade 20 which is helpful to reduce blade creep, and so on.

An improved method of cooling a turbine blade 20 in an environment of reduced differential pressure between inside and outside the turbine blade 20 is also provided with the present invention, particularly between passage 32 and the trailing edge 28. Cooling air circulated through the airfoil section 24 impinges along rib 40. The height of the rib 40 allows compensating for the reduced differential pressure and thus contributing to the internal cooling of the turbine blade 20. The height of the rib 40, and the size and number of openings 42 are chosen so a desired distribution of cooling air through the trailing edge exhaust ports 26 is achieved. Thus, the present invention provides both strengthening and cooling advantages.

The apparatus and method of cooling a turbine blade 20, may be used concurrently with other strengthening and/or cooling techniques in the blade, if desired.

While the above description addresses the preferred embodiments, it will be appreciated that the present invention is susceptible to modification and change without departing from the scope of the accompanying claims. The appended claims are intended to incorporate such modifications.

What is claimed is:

1. A gas turbine engine turbine blade, the turbine blade comprising a base section, an airfoil section and at least one internal cooling air passage, the airfoil having a having a trailing edge including a plurality of exit holes disposed therealong, the exit holes communicating with the internal cooling air passage, the exit holes being arranged relative to the passage such that the exit holes include at least one lower exit hole and at least one upper exit hole relative to the base section, the internal cooling air passage having a partial rib disposed therein which extends radially from the base section adjacent the trailing edge, the rib adapted to at least partially divert a flow in the passage therearound to redistribute pressure of the flow relative to the upper and lower exit holes, the rib further comprising a plurality of impingement holes substantially along its entire length.

2. An internally cooled turbine blade for a gas turbine engine, the turbine blade having a root section and a airfoil section generally radially extending from the root section, the airfoil section comprising a rear strengthening rib, the rib having a plurality of impingement holes substantially along its entire height and a height ranging between 0.3 and 0.9 the height of the airfoil section.

3. The turbine blade as defined in claim 2, wherein the height h of the rib is between 0.4 and 0.8 the height H of the airfoil section.

4. A turbine blade for use in a gas turbine engine, the turbine blade comprising a root section and an airfoil section with at least one internal cooling air passage, the turbine blade having a trailing edge and a partial rib disposed in the passage adjacent the trailing edge and extending radially from the root section, the partial rib having a plurality of impingement holes substantially along an entire radial height h thereof, wherein the radial height h is between 0.3 to 0.9 of a radial height H of the airfoil section, the rib thereby being adapted to balance a flow of cooling air through the passage to a plurality of exit holes adjacent the rib.

5. The turbine blade as defined in claim 4, wherein the height h of the rib is between 0.4 and 0.8 the height H of the airfoil section.

6. An internally cooled turbine blade for a gas turbine engine, the turbine blade having an airfoil section having a height H measured radially relative to the blade's orientation when installed in a turbine disc, the blade comprising at least one internal cooling passage defined in the blade, the passage having a partial rib disposed therein extending radially from the root section and disposed immediately adjacent a plurality of air passage outlets in a trailing edge of the blade, the rib having a height h and a plurality of impingement holes defined therethrough which communicate with the passage, wherein the rib height h is between 0.3 and 0.9 of the height H of the airfoil section and wherein a plurality of impingement holes are provided substantially along the entire rib height h to thereby provide impingement cooling to an airfoil skin area.

7. The turbine blade as defined in claim 6, wherein the height h of the rib is between 0.4 and 0.8 the height H of the airfoil section.

8. The turbine blade as defined in claim 6, wherein the rib is adapted to redistribute an air flow provided from the passage to the outlets.

* * * * *